US009662889B2

(12) United States Patent
Zhang et al.

(10) Patent No.: US 9,662,889 B2
(45) Date of Patent: May 30, 2017

(54) METHOD AND DEVICE FOR CHECKING NOZZLE OF INKJET PRINTER

(71) Applicants: PEKING UNIVERSITY FOUNDER GROUP CO., LTD., Beijing (CN); PEKING UNIVERSITY, Beijing (CN); FOUNDER INFORMATION INDUSTRY HOLDINGS CO., LTD., Beijing (CN); BEIJING FOUNDER ELECTRONICS CO., LTD., Beijing (CN)

(72) Inventors: Yongtai Zhang, Beijing (CN); Zhihong Liu, Beijing (CN)

(73) Assignees: PEKING UNIVERSITY FOUNDER GROUP CO., LTD., Beijing (CN); PEKING UNIVERSITY, Beijing (CN); FOUNDER INFORMATION INDUSTRY HOLDINGS CO., LTD., Beijing (CN); BEIJING FOUNDER ELECTRONICS CO., LTD., Beijing (CN)

( * ) Notice: Subject to any disclaimer, the term of this patent is extended or adjusted under 35 U.S.C. 154(b) by 0 days.

(21) Appl. No.: 14/915,928

(22) PCT Filed: Nov. 8, 2013

(86) PCT No.: PCT/CN2013/086738

§ 371 (c)(1),
(2) Date: Mar. 2, 2016

(87) PCT Pub. No.: WO2015/032127

PCT Pub. Date: Mar. 12, 2015

(65) Prior Publication Data

US 2016/0271957 A1 Sep. 22, 2016

(30) Foreign Application Priority Data

Sep. 3, 2013 (CN) ..... 2013 1 0395492

(51) Int. Cl.
*B41J 2/165* (2006.01)
*B41J 2/21* (2006.01)
*B41J 29/393* (2006.01)

(52) U.S. Cl.
CPC ..... *B41J 2/16579* (2013.01); *B41J 2/2142* (2013.01); *B41J 2/2146* (2013.01); *B41J 2029/3935* (2013.01)

(58) Field of Classification Search
CPC .... B41J 2/16579; B41J 2/2146; B41J 2/2142; B41J 2029/3935
See application file for complete search history.

(56) References Cited

U.S. PATENT DOCUMENTS 6,168,261 B1 * 1/2001 Miyake ..... B41J 2/2139 347/14
8,363,261 B1 1/2013 Zimmerman
2013/0187970 A1 7/2013 Inoue

FOREIGN PATENT DOCUMENTS

CN 1089551 7/1994
CN 102307676 1/2012
(Continued)

OTHER PUBLICATIONS

I Chinese Office Action for 201310395492.4, issued Dec. 3, 2015 (5 Pages).

(Continued)

*Primary Examiner* — Justin Seo
(74) *Attorney, Agent, or Firm* — Brinks Gilson & Lione

(57) ABSTRACT

A method and device for checking nozzles in an inkjet printer is disclosed. The checking method comprises: obtaining an electronically scanned image which is a printed paper image printed by the inkjet printer according to a checking image, correspondence relationships between pixel point positions and numbers of nozzles in the inkjet printer being preset in the checking image (step 11); ana- (Continued)

lyzing the scanned image to obtain pixel point positions free of ink in the scanned image (step 12); and according to the pixel point positions free of ink, obtaining and outputting the corresponding nozzle numbers (step 13). This invention may realize automatic checking of blocked nozzles, improve the convenience of checking, and reduce the error rate of checking.

8 Claims, 5 Drawing Sheets

(56) References Cited

FOREIGN PATENT DOCUMENTS

| | | | |
|---|---|---|---|
| EP | 1894728 | | 3/2008 |
| JP | 1994-079956 | A | 3/1994 |
| JP | 1998-006488 | A | 1/1998 |
| JP | 2003-329608 | A | 11/2003 |
| JP | 2006130407 | | 5/2006 |
| JP | 2008102311 | | 5/2008 |
| JP | 2008-207398 | A | 9/2008 |
| JP | 2009-220394 | A | 10/2009 |
| JP | 2011-121293 | A | 6/2011 |
| JP | 2013-147003 | A | 8/2013 |
| JP | 2013-169295 | A | 9/2013 |
| TW | 200520968 | | 7/2005 |

OTHER PUBLICATIONS

Japanese Office Action for Application No. JP2016-539388, dated Feb. 28, 2017 with translation;.

* cited by examiner

METHOD AND DEVICE FOR CHECKING NOZZLE OF INKJET PRINTER

CROSS-REFERENCE TO RELATED APPLICATIONS

This application is a national application of PCT/CN2013/086738, filed on Nov. 8, 2013, which application claims a right of priority to Chinese Patent Application No. 201310395492.4, filed Sep. 3, 2013, both of which are incorporated herein by reference in their entirety.

FIELD OF THE INVENTION

This invention relates to the field of checking nozzles in an inkjet printer, particularly to a method and device for checking nozzles in an inkjet printer.

DESCRIPTION OF THE RELATED ART

Nozzles of an inkjet printer are liable to be blocked after a period of time of use of the inkjet printer, which may cause broken lines, white stripes, lack of colors, obscured text, or even abnormal printing.

In inkjet printing, sometimes it is necessary to accurately determine the positions of blocked nozzles, i.e., the numbers of the blocked nozzles, to take corresponding measures to reduce impacts on printing quality caused by nozzle blocking. According to traditional methods for checking nozzle blocking, through printing a checking image (shown in FIG. 1) representing correspondence relationships between lines and the numbers of nozzles, whether there are some absent or broken lines is observed. Those absent broken lines may indicate that nozzles in those positions are blocked. According to the correspondence relationships between the lines on the checking map and the numbers of nozzles, the numbers of blocked nozzles may be identified. However, these methods depend on human interventions of operators, and thus are prone to cause errors and cannot realize online real-time checking.

The description in this specification for any techniques in the prior art should not be taken as an acknowledgement or any form of suggestion that this information forms the prior art already known to a person skilled in the art before the filing date of this application or the priority date of any claim of this application.

SUMMARY OF THE INVENTION

A technical problem to be solved in this invention is to provide a method and device for checking nozzles in an inkjet printer, so as to realize the automatic analysis and check of nozzle blocking in the inkjet printer.

In order to solve the above technical problem, a method for checking nozzles in an inkjet printer is provided in an embodiment of this invention, comprising:

obtaining an electronically scanned image which is obtained from a printed paper image that has been printed on the inkjet printer according to a checking image, the checking image being a predetermined checking image having correspondence relationships between pixel point positions and numbers of nozzles in the inkier printer;

analyzing the scanned image to obtain pixel point positions free of ink in the scanned image; and according to the pixel point positions free of ink, obtaining and outputting the corresponding nozzle numbers.

In one embodiment, when the checking image is printed on the inkjet printer, the pixel point positions of the checking image correspond to nozzle numbers of the inkjet printer according to the correspondence relationships.

In one embodiment, the step of analyzing the scanned image to obtain pixel positions free of ink in the scanned image comprises:

removing background colors and image noises from the scanned image to obtain a first scanned sub-image;

dividing the first scanned sub-image according to positions of points with ink in the first scanned sub-image to obtain a second scanned sub-image having multiple areas with ink;

correcting the areas with ink in the second scanned sub-image to obtain a third scanned sub-image; and finding out the pixel point positions free of ink from the third scanned sub-image.

In one embodiment, the step of correcting the areas with ink in the second scanned sub-image to obtain the third scanned sub-image comprises:

determining a size of the predetermined area with ink according to the checking image, a printing resolution of the inkjet printer and the scanning resolution of the scanned image; and correcting the area with ink in the second scanned sub-image according to the size of the predetermined area with ink to obtain the third scanned sub-image.

In one embodiment, the step of correcting the area with ink in the second scanned sub-image according to the size of the predetermined area with ink to obtain the third scanned sub-image comprises:

comparing the size of the area with ink in the second scanned sub-image and the size of the predetermined area with ink to obtain an incorrect area with ink having a difference from the size of the predetermined area with ink and the difference exceeding a predetermined error range;

determining whether the incorrect area with ink is a stain point area and obtaining a determination result; and in the case of a positive determination result, deleting the incorrect area with ink; otherwise, adjusting the incorrect area with ink to an area of the same size as the predetermined area with ink to obtain the third scanned sub-image.

In order to solve the above technical problem, a device for checking nozzles in an inkjet printer is provided in an embodiment of this invention, comprising:

an obtaining module for obtaining an electronically scanned image which is obtained from a printed paper image that has been printed on the inkjet printer according to a checking image, the checking image being a predetermined checking image having correspondence relationships between pixel point positions and numbers of nozzles in the inkjet printer;

an analyzing module for analyzing the scanned image to obtain pixel point positions free of ink in the scanned image; and an outputting module for obtaining and outputting the corresponding nozzle numbers according to the pixel point positions free of ink.

In one embodiment, when the checking image is printed on the inkjet printer, the pixel point positions of the checking image correspond to nozzle numbers of the inkjet printer according to the correspondence relationships.

In one embodiment, the analyzing module comprises:

a removing module for removing background colors and image noises from the scanned image to obtain a first scanned sub-image;

a division module for dividing the first scanned sub-image according to positions of points with ink in the first scanned sub-image to obtain a second scanned sub-image having multiple areas with ink;

a correction module for correcting the areas with ink in the second scanned sub-image to obtain a third scanned sub-image; and a finding module for finding out the pixel point positions free of ink from the third scanned sub-image.

In one embodiment, the correction module comprises:

a determination module for determining a size of a predetermined area with ink according to the checking image, a printing resolution of the inkjet printer and a scanning resolution of the scanned image; and a correction sub-module for correcting the area with ink in the second scanned sub-image to obtain the third scanned sub-image according to the size of the predetermined area with ink.

In one embodiment, the correction sub-module comprises:

a comparison module for comparing the size of the area with ink in the second scanned sub-image and the size of the predetermined area with ink to obtain an incorrect area with ink having a difference from the size of the predetermined area with ink and the difference exceeding a predetermined error range;

a determination module for determining whether the incorrect area with ink is a stain point area and obtaining a determination result; and an adjustment module for, in the case of a positive determination result, deleting the incorrect area with ink; otherwise, adjusting the incorrect area with ink to an area of the same size as the predetermined area with ink to obtain the third scanned sub-image.

The above technical solutions of this invention have the following beneficial effects.

In the method for checking nozzles in an inkjet printer provided in an embodiment of this invention, an electronically scanned image is first obtained, which is obtained from a printed paper image that has been printed on the inkjet printer according to a checking image, the checking image being a checking image having correspondence relationships between pixel point positions and numbers of nozzles in the inkjet printer; the scanned image is then analyzed to obtain pixel point positions free of ink in the scanned image; and according to the pixel point positions free of ink, the corresponding nozzle numbers are finally obtained and outputted. Automatic analysis and checking of nozzle blocking in the inkjet printer is realized, so that the convenience of checking may be increased and the error rate may be reduced.

DESCRIPTION OF THE EMBODIMENTS

For a more clear understanding of the technical problem to be solved in this invention, its technical solution and advantages, various exemplary embodiments of the present invention will now be described in detail with reference to the drawings.

It should be noted that the relative arrangement of the components and steps, the numerical expressions, and numerical values set forth in these embodiments do not limit the scope of the present invention unless it is specifically stated otherwise.

Meanwhile, it should be appreciated that, for the convenience of description, various parts shown in those drawings are not necessarily drawn on scale.

The following description of at least one exemplary embodiment is merely illustrative in nature and is in no way intended to limit the invention, its application, or uses.

Techniques, methods and apparatus as known by one of ordinary skill in the relevant art may not be discussed in detail but are intended to be part of the allowed specification where appropriate.

In all of the examples illustrated and discussed herein, any specific values should be interpreted to be illustrative only and non-limiting. Thus, other examples of the exemplary embodiments could have different values.

With the method for checking nozzles in an ink jet printer provided in an embodiment of this invention, automatic analysis and checking of nozzle blocking in the inkjet printer is realized, so that the convenience of checking may be increased and the error rate may be reduced.

Figure 1:
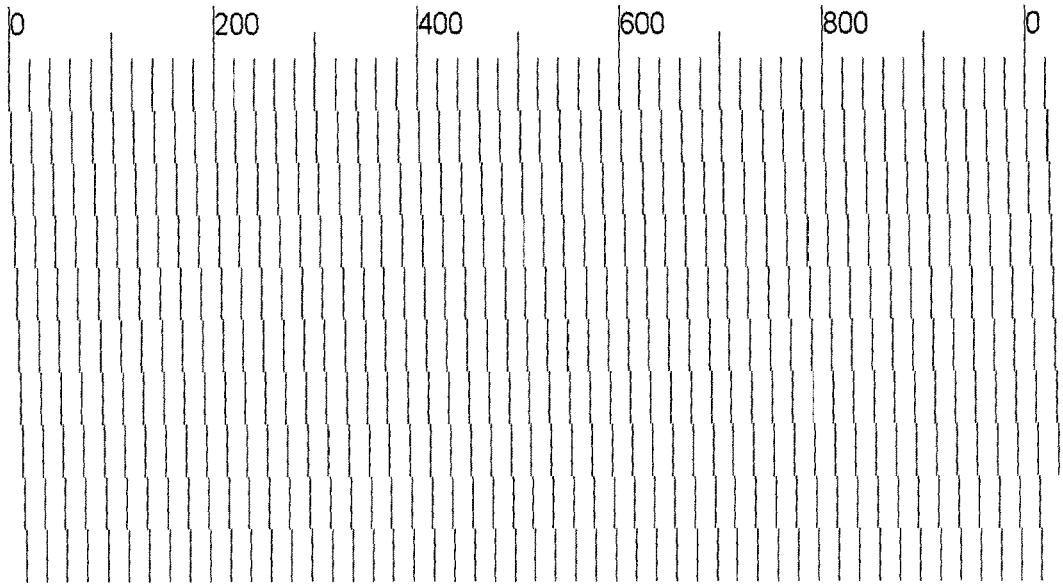
FIG. 1 is a checking diagram of a particular example of a method for checking nozzles in an inkjet printer in the prior art.
Figure 2:
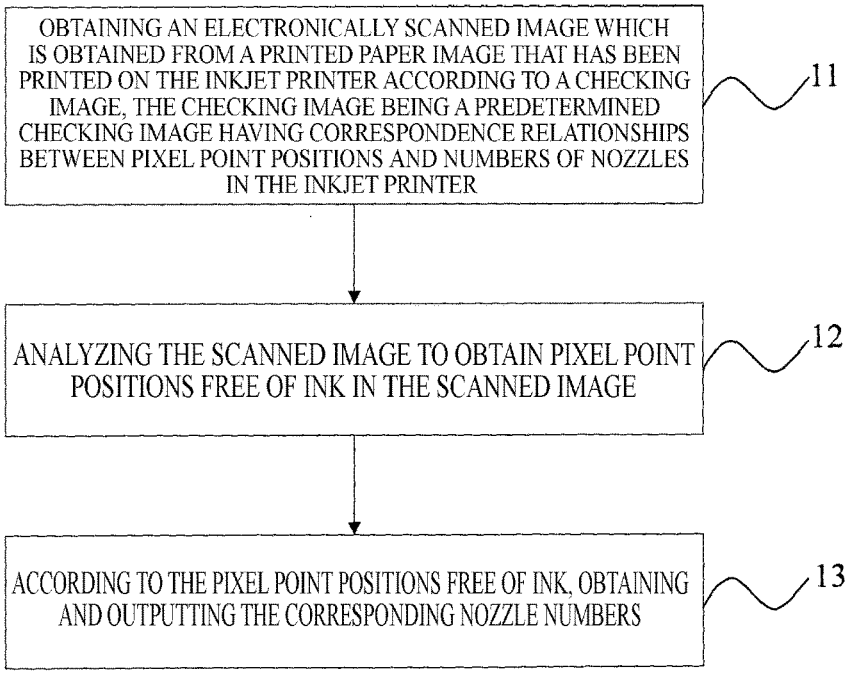
FIG. 2 is a block diagram of the flowchart of a method for checking nozzles in an inkjet printer of this invention.
Figure 3:
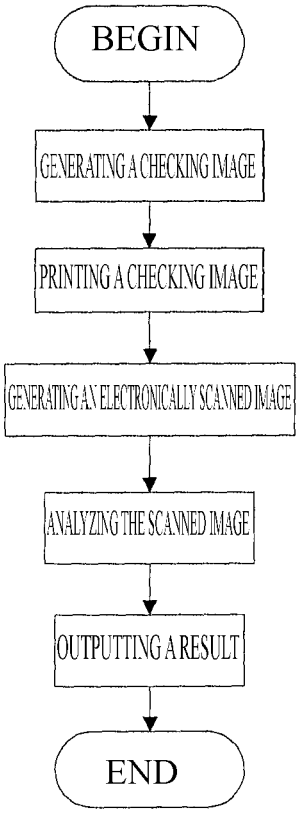
FIG. 3 is a flowchart of a method for checking nozzles in an inkjet printer of this invention.

As shown in FIGS. 2 and 3, the method for checking nozzles in an inkjet printer provided in an embodiment of this invention comprises the following steps.

Step 11, obtaining an electronically scanned image which is obtained from a printed paper image that has been printed on the inkjet printer according to a checking image, the checking image being a predetermined checking image having correspondence relationships between pixel point positions and numbers of nozzles in the inkjet printer.

Step 12, analyzing the scanned image to obtain pixel point positions free of ink in the scanned image.

Step 13, according to the pixel point positions free of ink, obtaining and outputting the corresponding nozzle numbers.

In the method for checking nozzles in an inkjet printer provided in an embodiment of this invention, an electronically scanned image is first obtained, which is obtained from a printed paper image that has been printed on the inkjet printer according to a checking image, the checking image being a checking image having correspondence relationships between pixel point positions and numbers of nozzles in the inkjet printer the scanned image is then analyzed to obtain pixel point positions free of ink in the scanned image; and according to the pixel point positions free of ink, the corresponding nozzle numbers are finally obtained and outputted. Automatic analysis and checking of nozzle blocking in the inkjet printer is realized so that the convenience of checking may be increased and the error rate may be reduced.

In this particular embodiment of this invention, when the checking image is printed on the inkjet printer, the pixel point positions of the checking image correspond to nozzle numbers of the inkjet printer according to the correspondence relationships. In this case, points with ink at pixel point positions on the printed checking image have the identical correspondence relationships with the numbers of nozzles in the inkjet printer, which may facilitate the subsequent analyzing and checking processes.

In one embodiment, the pixel points on the predetermined checking image may be spaced by five pixel points or even more, so that there is a larger distance between adjacent pixel points, making a larger distance between adjacent points with ink that have been printed, thereby the adjacent points with ink are prevented from joining with each other due to ink diffusion, which may affect nozzle checking in the inkjet printer.

Figure 4:
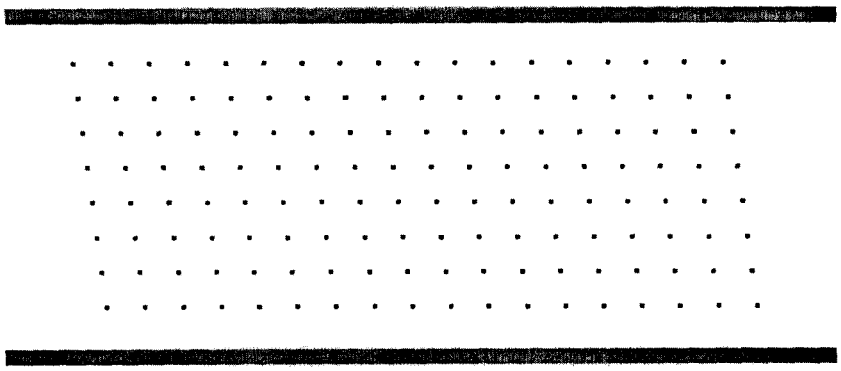
FIG. 4 is a checking diagram of a particular embodiment of the method for checking nozzles in an inkjet printer of this invention.
Figure 5:
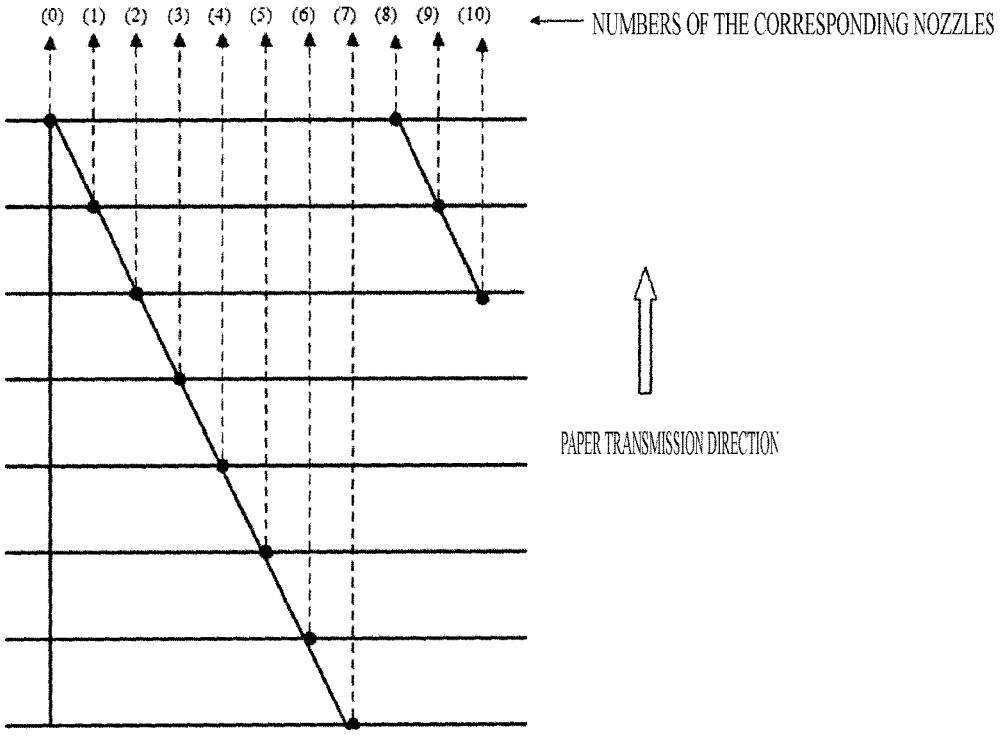
FIG. 5 is a correspondence relationship diagram of a particular embodiment of the method for checking nozzles in an inkjet printer of this invention.

In a particular embodiment, as shown in FIG. 4, the adjacent pixel points in the same line of the checking image are spaced by seven pixel points, two lines are spaced by seven pixel points, and are staggered by one pixel point. In this case, adjacent points with ink in a printed checking image are prevented from being confused due to ink diffusion, so that a subsequent checking process may be carried out smoothly. In one embodiment, correspondence relationships between pixel points in the checking image and the numbers of nozzles in the inkjet printer are shown in FIG. 5. During printing, the pixel point positions in the checking image correspond to the numbers of nozzles in the inkjet printer according to the correspondence relationship as shown in FIG. 5. The printing direction is the transmission direction of the paper as shown in FIG. 5.

Step 12 described above may comprise the following steps.

Step 121: removing background colors and image noises from the scanned image to obtain a first scanned sub-image.

Step 122: dividing the first scanned sub-image according to positions of points with ink in the first scanned sub-image to obtain a second scanned sub-image having multiple areas with ink.

Step 123: correcting the areas with ink in the second scanned sub-image to obtain a third scanned sub-image.

Step 124: finding out the pixel point positions free of ink from the third scanned sub-image.

According to an embodiment of the method for checking nozzles in an inkjet printer provided in this invention, through organizing and analyzing the obtained electrically scanned image, positions of blocked nozzles may be found accurately and rapidly, so that the convenience of checking may be increased and the error rate may be reduced.

In the particular embodiment of this invention, the method for removing image noises in the scanned image may be the mean filter removing method, the median filter removing method, the morphology filter removing method, etc. Any method for removing image noises in the prior art may be adopted in particular embodiments of this invention, and will not be listed specifically.

Below, the particular embodiments of this invention will be illustrated.

Figure 6:
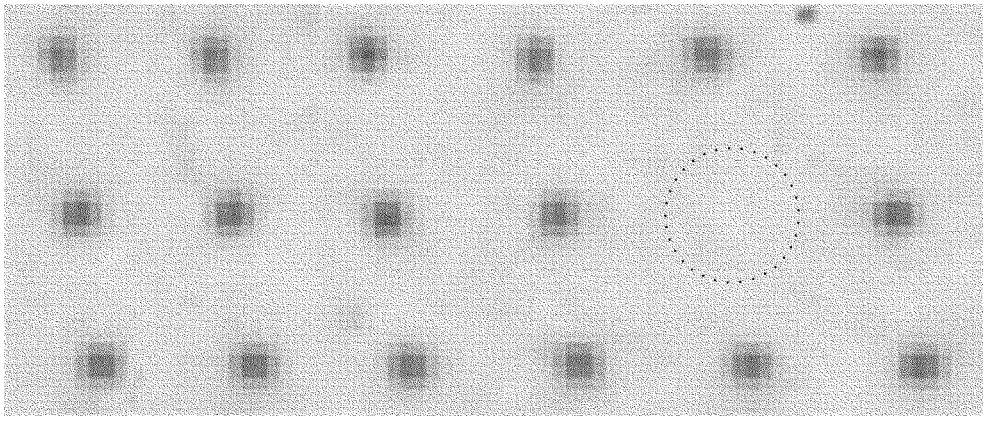
FIG. 6 is a scanned image of a particular embodiment of the method for checking nozzles in an inkjet printer of this invention.

Assume that a scanned image obtained according to the checking image shown in FIG. 4 is shown in FIG. 6, in which, due to nozzle blocking, an point with ink that should be at the position of the dashed circle is absent. The scanned image will be analyzed as follows.

Figure 7:
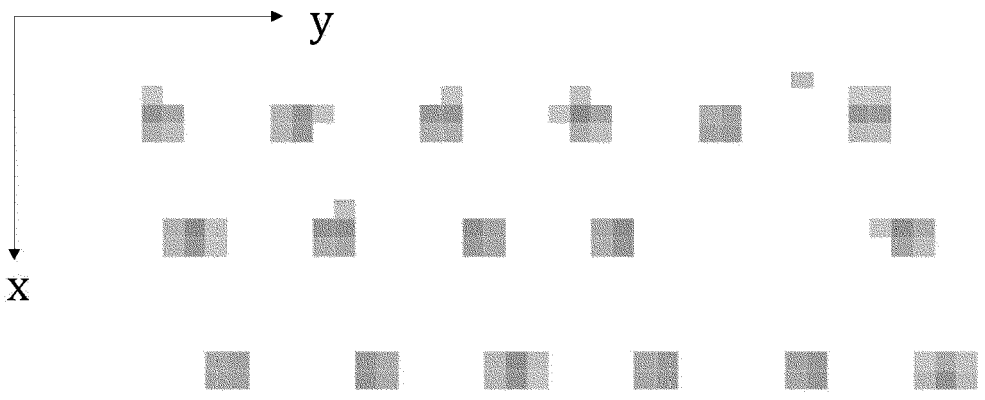
FIG. 7 is a first scanned sub-image of a particular embodiment of the method for checking nozzles in an inkjet printer of this invention.

First of all, background colors and image noises are removed from the scanned image, so that positions of points with ink in the scanned image may be shown clearly, and a first scanned sub-image shown in FIG. 7 is obtained.

Figure 8:
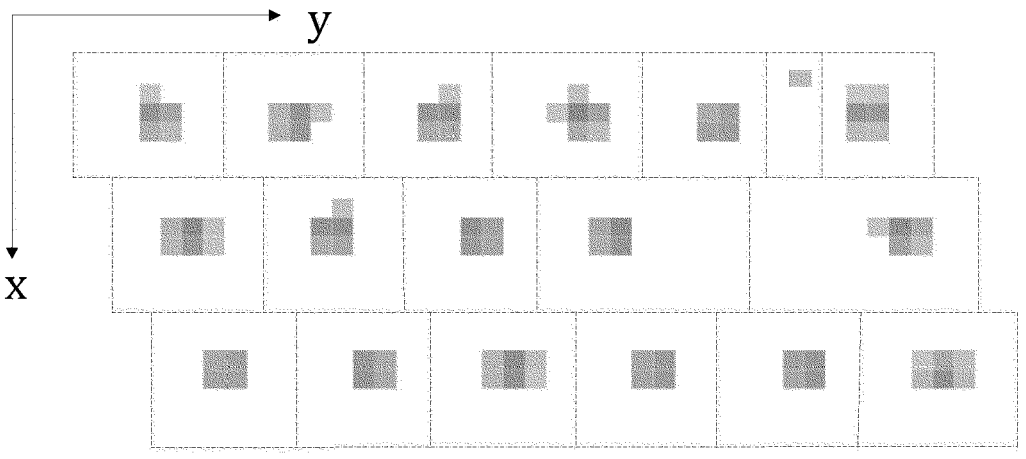
FIG. 8 is a second scanned sub-image of a particular embodiment of the method for checking nozzles in an inkjet printer of this invention.

According positions of various points with ink in the first scanned sub-image, the first scanned sub-image is divided. Particularly, separation marks are provided in the spacing between adjacent points with ink in the first scanned sub-image to enclose the points with ink in individual communicated areas with the separation marks, so that a second scanned sub-image having multiple areas with ink is obtained as shown in FIG. 8.

Figure 9:
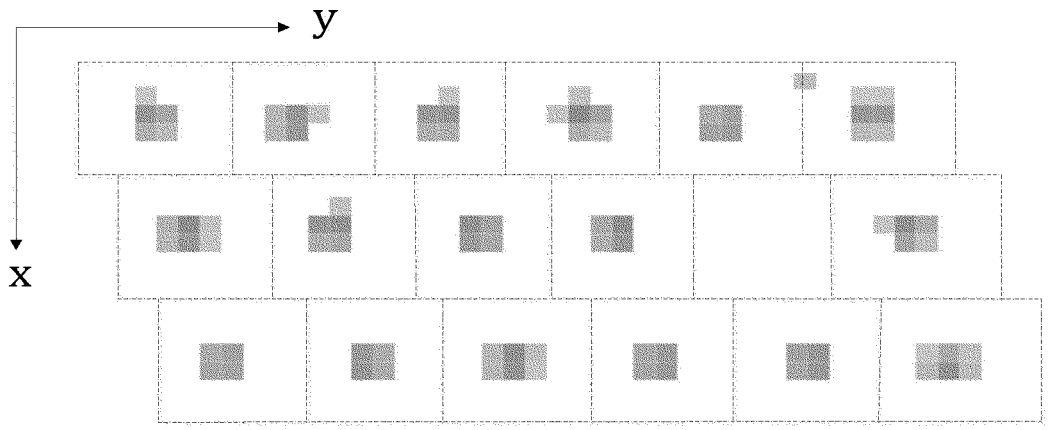
FIG. 9 is a third scanned sub-image of a particular embodiment of the method for checking nozzles in an inkjet printer of this invention.

Due to the presence of stain points and nozzle blocking, there may be errors in the division of the first scanned sub-image. Thus, the areas with ink in the second scanned sub-image need to be corrected to obtain a corrected third scanned sub-image, as shown in FIG. 9.

Finally, according to the third scanned sub-image, each area with ink in the third scanned sub-image is traversed to find out pixel point positions free of ink.

In one embodiment, step 123 described above may particularly comprises the following steps.

Step 1231: determining a size of the predetermined area with ink according to the checking image, a printing resolution of the inkjet printer and the scanning resolution of the scanned image.

Step 1232: correcting the area with ink in the second scanned sub-image to obtain the third scanned sub-image according to the size of the predetermined area with ink.

Through correcting the areas with ink in the second scanned sub-image, the areas with ink in the third scanned sub-image and the pixel point positions in the scanned image have a one-to-one correspondence relationship. Because interference has been removed, pixel point positions free of ink may be found distinctly and rapidly.

In a particular embodiment, the checking image is shown in FIG. 4, a first distance between adjacent pixels on each line is seven pixel points, a second distance between every two lines is seven pixel points, assume that the printing resolution of the inkjet printer is 360 dpi, each nozzle corresponds to one pixel, the scanning resolution of the scanned image is also 360 dpi, the predetermined area with ink is determined as 7 pixel points by 7 pixel points. Areas with ink in the second scanned sub-image are corrected according to the size of the predetermined area with ink to obtain a third scanned sub-image.

In one embodiment, step 1232 particularly comprises the following steps.

Step 12321: comparing the size of the area with ink in the second scanned sub-image and the size of the predetermined area with ink to obtain an incorrect area with ink having a difference from the size of the predetermined area with ink and the difference exceeding a predetermined error range.

Step 12322: determining whether the incorrect area with ink is a stain point area and obtaining a determination result.

Step 12323: in the case of a positive determination result, deleting the incorrect area with ink, otherwise, adjusting the incorrect area with ink to an area of the same size as the predetermined area with ink to obtain the third scanned sub-image.

Through removing stain point areas in the second scanned sub-image, and adjusting incorrect areas with ink among non-stain point areas to areas of the same size as the predetermined area with ink, the areas with ink in the third scanned sub-image and pixel point positions in the scanned image may obtain a better correspondence relationship, facilitating the finding of pixel point positions free of ink.

Below, the particular embodiments of this invention will be illustrated.

Assume that a second scanned sub-image obtained based on the checking image of FIG. 4 is shown in FIG. 8, the size of the predetermined area with ink is 7 pixel points by 7 pixel points. If different areas with ink are represented by coordinates in the form of AREA(n,m) in a X-Y coordinate system shown in FIG. 8, wherein n and m represent coordinate values corresponding to an area with ink. AREA (1,6) represents an incorrect area A caused by a stain, AREA (2,4) and AREA (2,5) represent two incorrect areas B and C caused by nozzle blocking. Through comparing the size of the area with ink in FIG. 8 and the size of the predetermined area with ink, incorrect area with ink AREA (1,5), AREA (1,6), AREA (1,7), AREA (2,4) and AREA (2,5) having different sizes from that of predetermined area with ink may be obtained. Then, it is determined whether the found incorrect areas with ink are stain point areas. The stain point area AREA(1,6) is deleted and non-stain point areas AREA (1,5), AREA (1,7), AREA (2,4) and AREA (2,5) are adjusted to the size of 7 pixel points by 7 pixel points to complete the correction of the second scanned sub-image and obtain a third scanned sub-image as shown in FIG. 9.

According to the method for checking nozzles in an inkjet printer, automatic analysis and checking of nozzle blocking in the inkjet printer is realized, so that the convenience of checking may be increased and the error rate may be reduced.

Figure 10:
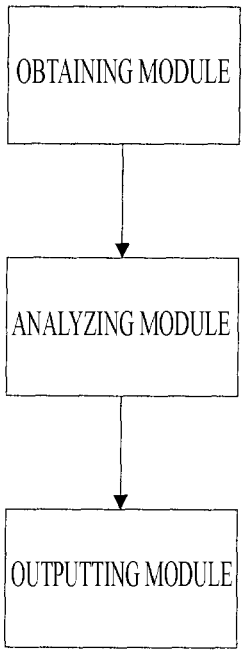
FIG. 10 is a system block diagram of a device for checking nozzles in an inkjet printer of this invention.

As shown in FIG. 10, a device for checking nozzles in an inkjet printer is provided in an embodiment of this invention, comprising:

an obtaining module for obtaining an electronically scanned image which is obtained from a printed paper image that has been printed on the inkjet printer according to a checking image, the checking image being a predetermined checking image having correspondence relationships between pixel point positions and numbers of nozzles in the inkjet printer;

an analyzing module for analyzing the scanned image to obtain pixel point positions free of ink in the scanned image; and an outputting module for obtaining and outputting the corresponding nozzle numbers according to the pixel point positions free of ink.

According to the device for checking nozzles in an inkjet printer, automatic analysis and checking of nozzle blocking in the inkjet printer is realized, so that the convenience of checking may be increased and the error rate may be reduced.

In the particular embodiment of the present invention, in the obtaining module, when the checking image is printed on the inkjet primer, the pixel point positions of the checking image correspond to nozzle numbers of the inkjet printer according to the correspondence relationships. In this case, the points with ink at the pixel point positions on the printed checking image and nozzle numbers in the inkjet printer have the same correspondence relationships.

In one embodiment, the analyzing module comprises:

a removing module for removing background colors and image noises from the scanned image to obtain a first scanned sub-image;

a division module for dividing the first scanned sub-image according to positions of points with ink in the first scanned sub-image to obtain a second scanned sub-image having multiple areas with ink;

a correction module for correcting the areas with ink in the second scanned sub-image to obtain a third scanned sub-image; and a finding module for finding out the pixel point positions free of ink from the third scanned sub-image.

With the device for checking nozzles in an inkjet printer, positions of blocked nozzles may be found accurately, so that the convenience of checking may be increased and the error rate may be reduced.

In one embodiment, the correction module comprises:

a determination module for determining a size of a predetermined area with ink according to the checking image, a printing resolution of the inkjet printer and a scanning resolution of the scanned image; and a correction sub-module for correcting the area with ink in the second scanned sub-image to obtain the third scanned sub-image according to the size of the predetermined area with ink.

Through correcting the areas with ink in the second scanned sub-image, interference may be removed, so that pixel point positions free of ink may be found distinctly and rapidly.

In one embodiment, the correction sub-module comprises:

a comparison module for comparing the size of the area with ink in the second scanned sub-image and the size of the predetermined area with ink to obtain an incorrect area with ink having a difference from the size of the predetermined area with ink and the difference exceeding a predetermined error range;

a determination module for determining whether the incorrect area with ink is a stain point area and obtaining a determination result; and an adjustment module for, in the case of a positive determination result, deleting the incorrect area with ink; otherwise, adjusting the incorrect area with ink to an area of the same size as the predetermined area with ink to obtain the third scanned sub-image.

Through removing stain point areas in the second scanned sub-image, and adjusting the incorrect areas with ink among non-stain point areas to the areas of the same size as the predetermined area with ink, areas with ink in the third scanned sub-image and pixel point positions in the scanned image have a better correspondence relationship, facilitating the finding of pixel point positions free of ink.

With the device for checking nozzles in an inkjet printer of the embodiment in the present invention, automatic analysis and checking of nozzle blocking in the inkjet printer is realized, so that the convenience of checking may be increased and the error rate may be reduced.

Note that the device is a device corresponding to the above method embodiment. All implementations of the above method embodiment are applicable to the device embodiment and may achieve the same technical effects.

This disclosure also provides one or more computer readable mediums having stored thereon computer-executable instructions that when executed by a computer perform a method for checking nozzles in an inkjet printer, comprising: obtaining an electronically scanned image which is obtained from a printed paper image that has been printed on the inkjet printer according to a checking image, the checking image being a predetermined checking image having correspondence relationships between pixel point positions and numbers of nozzles in the inkjet printer, analyzing the scanned image to obtain pixel point positions free of ink in the scanned image; and according to the pixel point positions free of ink, obtaining and outputting the corresponding nozzle numbers.

This disclosure also provides a computer comprising one or more computer readable mediums having stored thereon computer-executable instructions that when executed on the computer perform the above method for checking nozzles in an inkjet printer.

Exemplary Operating Environment

The computer or computing device as described herein comprises hardware, including one or more processors or processing units, system memory and some types of computer readable media. By way of example and not limitation, computer readable media comprise computer storage media and communication media. Computer storage media comprises volatile or non-volatile, removable or non-removable media implemented in any method or technology for storage of information such as computer readable instructions, data structures, program modules or other data. Communication media typically embody computer readable instructions, data structures, program modules, or other data in a modulated data signal such as a carrier wave or other transport mechanism and include any information delivery media. Combinations of any of the above are also included within the scope of computer readable media.

The computer may use one or more remote computers, such as logical connections to remote computers operated in a networked environment. Although various embodiments of the present disclosure are described in the context of the exemplary computing system environment various embodiments of the present disclosure may be used with numerous other general purpose or application specific computing system environments or configurations. The computing system environment is not intended for limiting any aspect of the scope of use or functionality of the invention. In addition, the computer environment should not be interpreted as depending on or requiring any one or combination of components shown in the exemplary operating environment. Well-known examples of the computing systems, the environment and/or configurations suitable for all aspects of the present disclosure include, but are not limited to: personal computers, server computers, handheld or laptop devices, multiprocessor systems, microprocessor-based systems, set top boxes, programmable consumer electronics, mobile phone, network PC, minicomputers, mainframe computers, distributed computing environments including any one of the above systems or devices, and so on.

Various embodiments of the invention may be described in a general context of computer executable instructions such as program modules executed on one or more computers or other devices.

The computer-executable instructions may be organized into one or more computer-executable components or modules as software. Generally, program modules include, but are not limited to, routines, programs, objects, components, and data structures that perform particular tasks or implement particular abstract data types. Aspects of the invention may be implemented with any number and organization of such components or modules. For example, aspects of the invention are not limited to the specific computer-executable instructions or the specific components or modules illustrated in the figures and described herein. Other embodiments of the invention may include different computer-executable instructions or components having more or less functionality than illustrated and described herein. Aspects of the invention may also be practiced in distributed computing environments where tasks are performed by remote processing devices that are linked through a communications network. In a distributed computing environment, program modules may be located in both local and remote computer storage media including memory storage devices.

The descriptions above are just preferred implementing ways of the invention. It should be noted that many improvements and embellishments may be made to the invention without departing the scope of the present invention. The improvements and embellishments should be interpreted as within the scope of the present invention.

What is claimed is:

1. A method for checking nozzles in an inkjet printer, the method comprising the steps of:

obtaining an electronically scanned image which is obtained from a printed paper image that has been printed on the inkjet printer according to a checking image, the checking image being a predetermined checking image having correspondence relationships between pixel point positions and numbers of nozzles in the inkjet printer;

analyzing the scanned image to obtain pixel point positions free of ink in the scanned image; and according to the pixel point positions free of ink, obtaining and outputting the corresponding nozzle numbers, wherein the step of analyzing the scanned image to obtain pixel positions free of ink in the scanned image comprises:

removing background colors and image noises from the scanned image to obtain a first scanned sub-image;

dividing the first scanned sub-image according to positions of points with ink in the first scanned sub-image to obtain a second scanned sub-image having multiple areas with ink;

correcting the areas with ink in the second scanned sub-image to obtain a third scanned sub-image; and finding out the pixel point positions free of ink from the third scanned sub-image.

2. The method of claim 1, characterized in that, when the checking image is printed on the inkjet printer, the pixel point positions of the checking image correspond to nozzle numbers of the inkjet printer according to the correspondence relationships.

3. The method of claim 1, characterized in that the step of correcting the areas with ink in the second scanned sub-image to obtain the third scanned sub-image comprises:

determining a size of the predetermined area with ink according to the checking image, a printing resolution of the inkjet printer and the scanning resolution of the scanned image; and correcting the area with ink in the second scanned sub-image to obtain the third scanned sub-image according to the size of the predetermined area with ink.

4. The method of claim 3, characterized in that the step of correcting the area with ink in the second scanned sub-image according to the size of the predetermined area with ink to obtain the third scanned sub-image comprises:

comparing the size of the area with ink in the second scanned sub-image and the size of the predetermined area with ink to obtain an incorrect area with ink having a difference from the size of the predetermined area with ink and the difference exceeding a predetermined error range;

determining whether the incorrect area with ink is a stain point area and obtaining a determination result; and in the case of a positive determination result, deleting the incorrect area with ink; otherwise, adjusting the incorrect area with ink to an area of the same size as the predetermined area with ink to obtain the third scanned sub-image.

5. A device for checking nozzles in an inkjet printer, characterized in comprising:

an obtaining module for obtaining an electronically scanned image which is obtained from a printed paper image that has been printed on the inkjet printer according to a checking image, the checking image being a predetermined checking image having correspondence relationships between pixel point positions and numbers of nozzles in the inkjet printer;

an analyzing module for analyzing the scanned image to obtain pixel point positions free of ink in the scanned image; and an outputting module for obtaining and outputting the corresponding nozzle numbers according to the pixel point positions free of ink, wherein the analyzing module comprises:

a removing module for removing background colors and image noises from the scanned image to obtain a first scanned sub-image;

a division module for dividing the first scanned sub-image according to positions of points with ink in the first scanned sub-image to obtain a second scanned sub-image having multiple areas with ink;

a correction module for correcting the areas with ink in the second scanned sub-image to obtain a third scanned sub-image; and a finding module for finding out the pixel point positions free of ink from the third scanned sub-image.

6. The device of claim 5, characterized in that, when the checking image is printed on the inkjet printer, the pixel point positions of the checking image correspond to nozzle numbers of the inkjet printer according to the correspondence relationships.

7. The device of claim 5, characterized in that the correction module comprises:

a determination module for determining a size of a predetermined area with ink according to the checking image, a printing resolution of the inkjet printer and a scanning resolution of the scanned image; and a correction sub-module for correcting the area with ink in the second scanned sub-image to obtain the third scanned sub-image according to the size of the predetermined area with ink.

8. The device of claim 7, characterized in that the correction sub-module comprises:

a comparison module for comparing the size of the area with ink in the second scanned sub-image and the size of the predetermined area with ink to obtain an incorrect area with ink having a difference from the size of the predetermined area with ink and the difference exceeding a predetermined error range;

a determination module for determining whether the incorrect area with ink is a stain point area and obtaining a determination result; and an adjustment module for, in the case of a positive determination result, deleting the incorrect area with ink; otherwise, adjusting the incorrect area with ink to an area of the same size as the predetermined area with ink to obtain the third scanned sub-image.

* * * * *